US006997360B2

(12) United States Patent
Cohn

(10) Patent No.: US 6,997,360 B2
(45) Date of Patent: Feb. 14, 2006

(54) NO-SPLATTER SPOUT

(76) Inventor: Douglas A. Cohn, 6601 Georgetown Pike, McLean, VA (US) 22101

( * ) Notice: Subject to any disclaimer, the term of this patent is extended or adjusted under 35 U.S.C. 154(b) by 0 days.

(21) Appl. No.: 10/310,885

(22) Filed: Dec. 6, 2002

(65) Prior Publication Data

US 2003/0132255 A1 Jul. 17, 2003

Related U.S. Application Data

(60) Provisional application No. 60/336,149, filed on Dec. 6, 2001.

(51) Int. Cl.
*B65D 25/40* (2006.01)

(52) U.S. Cl. ..... 222/567; 222/571; 222/564; 220/719

(58) Field of Classification Search ..... 272/567, 272/571–572, 564, 547; 215/41, DIG. 8; 220/719; 222/567, 564, 571–572, 547
See application file for complete search history.

(56) References Cited

U.S. PATENT DOCUMENTS 1,357,629 A * 11/1920 Faistl et al. ..... 222/572
2,205,147 A * 6/1940 Madsen ..... 99/323.1
2,442,047 A * 5/1948 Kemper ..... 222/571
2,735,594 A * 2/1956 Carnes ..... 222/567
2,803,375 A * 8/1957 Meshberg ..... 206/515
3,632,049 A * 1/1972 Winters ..... 239/590
3,833,150 A * 9/1974 Visser-Patings ..... 222/109
4,078,700 A * 3/1978 Hidding ..... 222/109
4,637,530 A * 1/1987 Jiang ..... 222/564
4,651,900 A * 3/1987 Horvath et al. ..... 222/144.5
4,957,224 A * 9/1990 Kessler et al. ..... 222/465.1

OTHER PUBLICATIONS

The Encyclopedia Americans International Edition, 1829, see pp. 164-165 and 194-195.*
McGraw-Hill Encyclopedia of Science & Technology, Fifth Edition, 1982, see pp. 139-140, 1135-1136 and G8.*

* cited by examiner

*Primary Examiner*—Frederick Nicolas
(74) *Attorney, Agent, or Firm*—Bacon & Thomas PLLC

(57) ABSTRACT

A vertical blade in the spout of a container, on the inside lip of a container or across the top diameter of a container. The blade forms a triangle in the center of the spout. In a spoutless container, the blade extends from the top lip horizontally inside the container for up to two inches, then diagonally down to the inside of the container. Placed across the diameter of a container, the top of the blade is flush with the top of the container and extends down to a maximum of two inches, making a rectangle across the container. Splattering is prevented because liquid is cut, then pulled toward the center. Cohesion pulls liquid toward the blade. Adhesion brings the liquid together after it passes the blade.

1 Claim, 4 Drawing Sheets

NO-SPLATTER SPOUT

This application claims the benefit of the filing of provisional application No. 60/336,149, filed on Dec. 6. 2001.

FIELD OF THE INVENTION

The present invention relates to spill inhibiting of a liquid poured from a container.

BACKGROUND OF THE INVENTION

Molecules of a liquid are attracted to each other. This is called adhesion. They are also attracted to other materials such as glass, metal, and plastic. This is called cohesion.

As a result the liquid has a tendency to spreadout along the rim, causing the liquid to splatter. This tendency increases as viscosity increases, which is why a thick liquid such as paint or a milkshake splatters more than water.

This situation is exacerbated when the liquid coagulates, causing curdling or clotting, which are extreme forms of adhesion. This phenomenom is exemplified by a thick milkshake, but is not to be confused with solids such as frozen liquids. A thick milkshake can be poured; a scoop of ice cream cannot.

The No-Splatter Spout eliminates the splatter problem through the insertion of a vertical blade in the spout of a container, on the inside lip of a container or across the top diameter of a container.

If placed in the spout, the blade makes a triangle from the top point of the spout down the angled incline of the spout until it reaches the container proper and then up until it forms a right angle and continues back to the point of the spout.

If placed on the inside lip of a container, the blade extends from the lip horizontally inside the container for up to two inches, then diagonally down to the inside of the container to a point up to two inches below the top edge of the container.

If the blade is placed across the diameter of a container, the top of the blade should be flush with the top of the container. It should extend down to a maximum of two inches, making a rectangle across the container or it can be angled up toward the center of the container, creating an archlike effect.

The material used for the blade should have the same or greater cohesiveness as the material used in the container.

U.S. Pat. No. 6,318,604 discloses a spill inhibiting spout. The spout disclosed is quite complicated as it includes structure for flow control.

SUMMARY OF THE INVENTION

The blade should be thin to enable it to "cut" the liquid at the point farthest from the spout point or container lip, though it is not necessary that it be of uniform thickness.

The no-splatter spout works by using cohesion and adhesion on a vertical plane. The blade separates the liquid, but when it reaches the end of the blade at the end of the spout or lip of the container, cohesion, having attracted the liquid to the blade surface, will be overtaken by adhesion and the liquid from each side of the blade will come together. This pull toward the center prevents splattering.

DESCRIPTION OF THE PREFERRED EMBODIMENT

Figure 1:
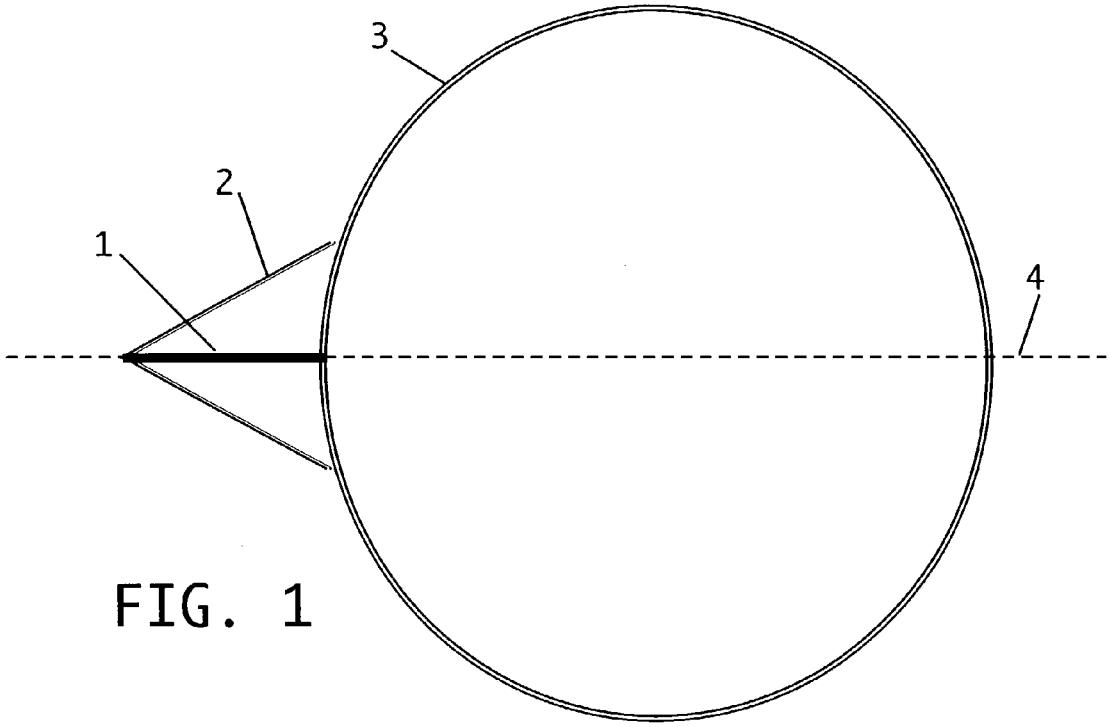
FIG. 1 is a top view of a container showing the top of the blade of the No-Splatter Spout.
Figure 2:
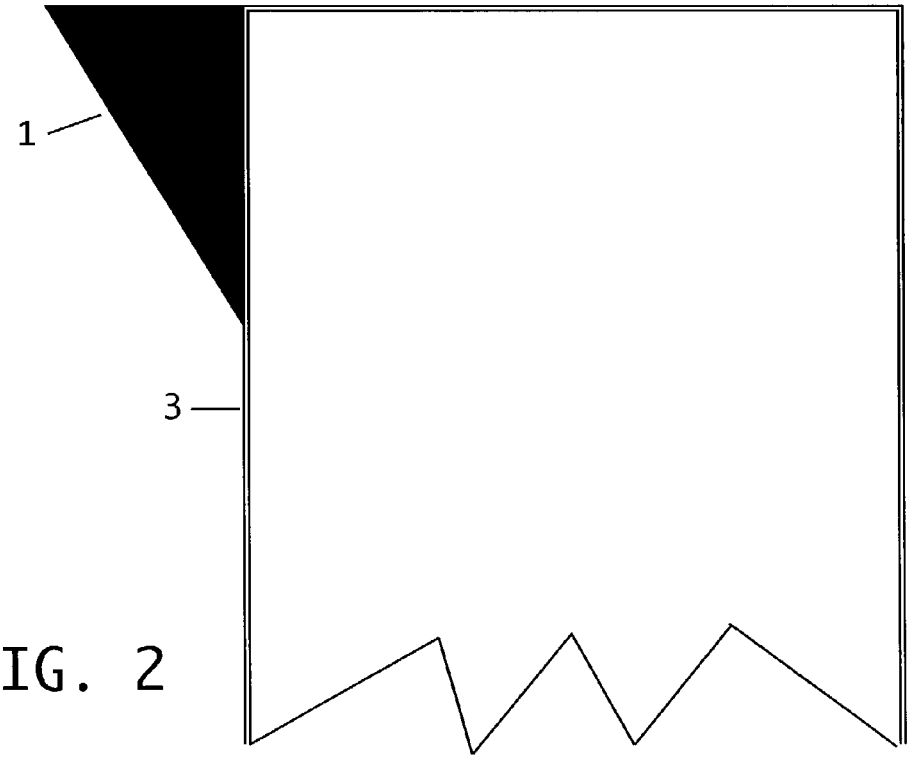
FIG. 2 is a vertical cross-sectional view of the container that shows a profile of the No-Splatter Spout blade.

Referring now to FIG. 1, in which the top of a container 3 with a spout 2 is represented. The cross-section notation 4 is referenced for the cross-section of the container in FIG. 2. The No-Splatter blade in FIG. 1 and FIG. 2 which may may be of varying thickness is designed to "cut" liquid as it moves from the container into the spout. As the container is tilted to pour the liquid, cohesion causes the liquid to be drawn to the blade 1, and when the liquid reaches the end of the spout and the end of the No-Splatter blade, adhesion compells it to come together in the center. This prevents splattering.

Figure 3:
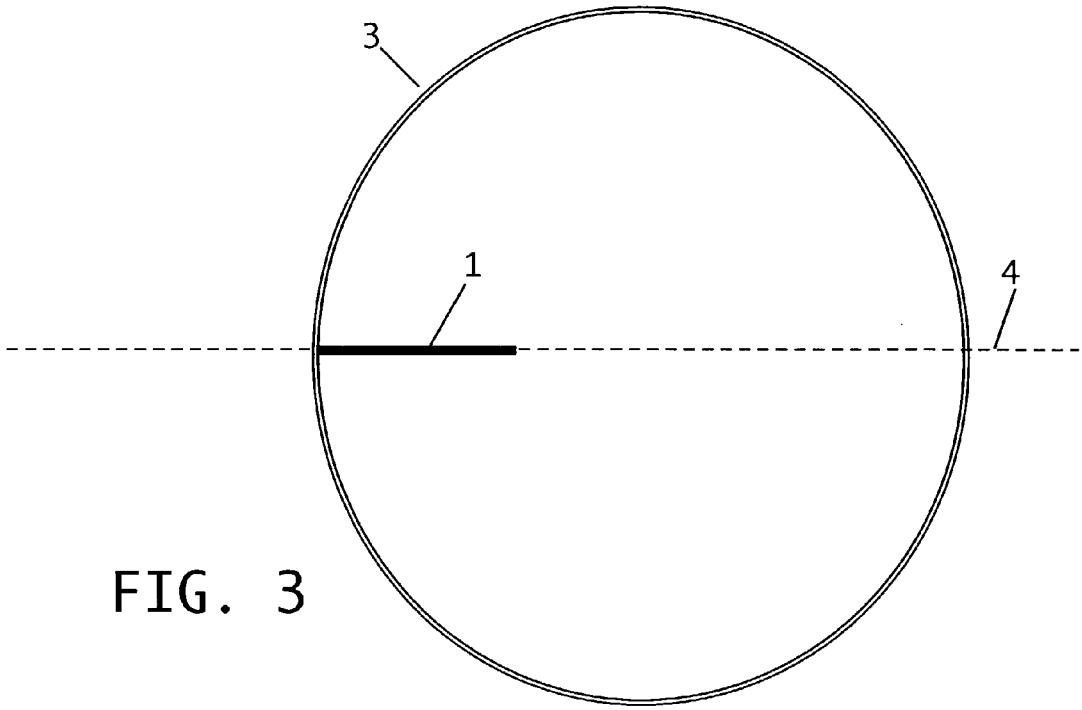
FIG. 3 is a top view of a spoutless container that shows top of the No-Splatter blade.
Figure 4:
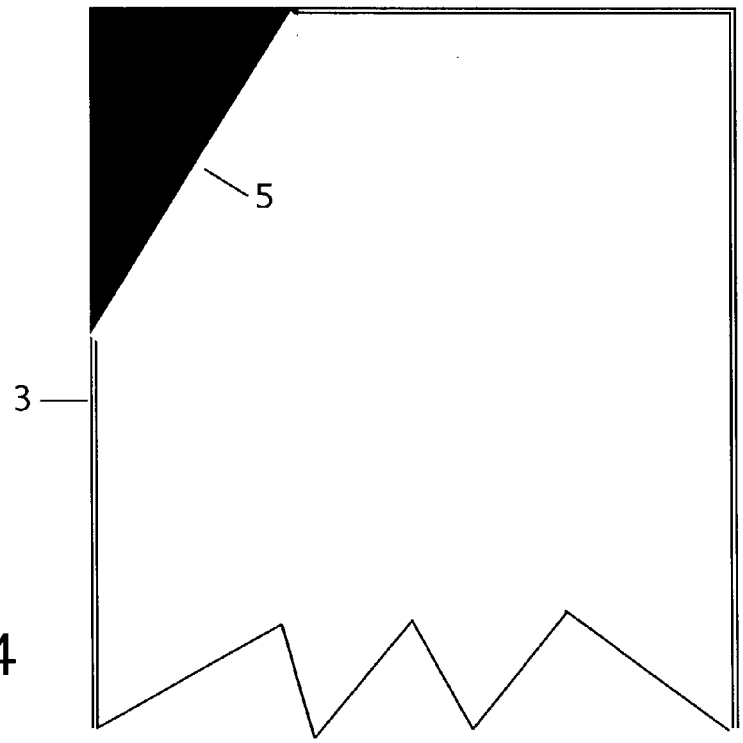
FIG. 4 is a vertical cross-sectional view of a spoutless container that shows the profile of the No-Splatter blade.

FIG. 3 and FIG. 4 show, respectively the top and cross-section of a spoutless container 3. The cross-section notation 4 is referenced for the cross-section of the container in FIG. 4. The No-Splatter blade 5 creates an internal spout in the spoutless container, functioning on the same basis of cohesion and adhesion as in the spouted container in FIG. 1 and FIG. 2.

Figure 5:
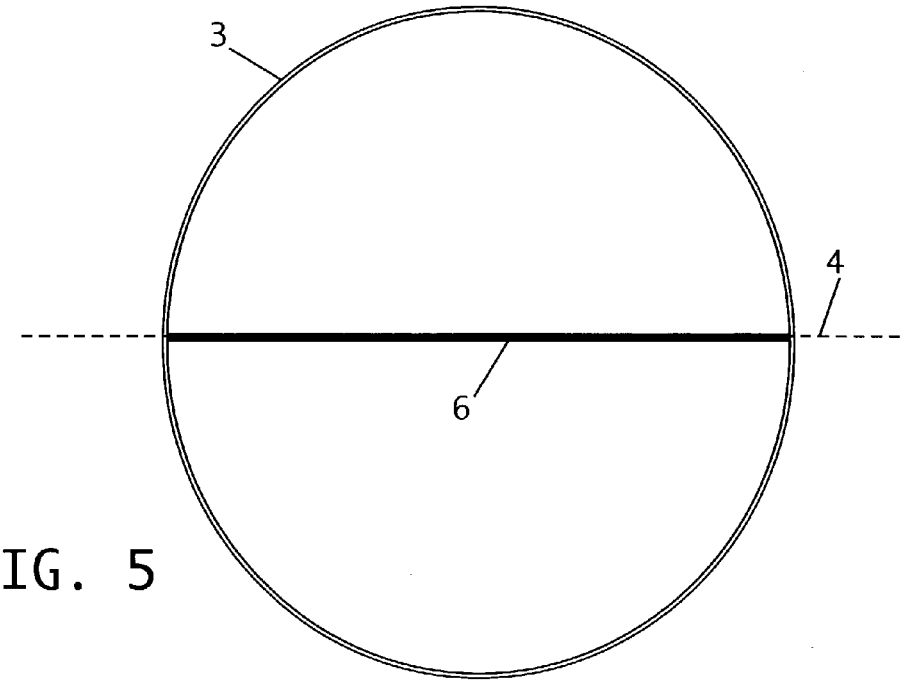
FIG. 5 is a top view of a spoutless container that shows the top of the No-Splatter blade extending across the diameter of the container.
Figure 6:
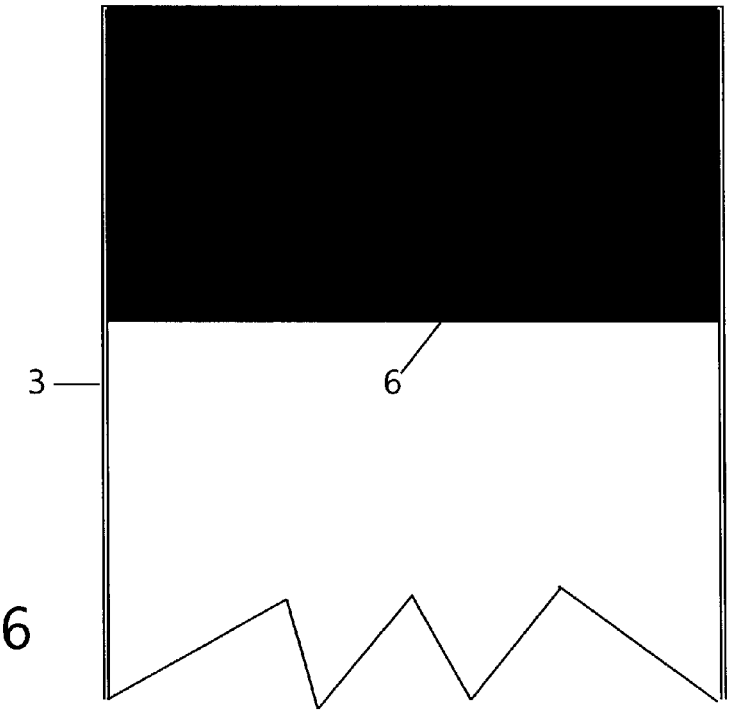
FIG. 6 is a vertical cross-sectional view of a spoutless container showing the profile of the No-Splatter blade extending across the diameter of the container.

FIG. 5 and FIG. 6 show, respectively the top and cross-section of a spoutless container 3. The cross-section notation 4 is referenced for the cross-section of the container in FIG. 4. The No-Splatter blade 6 creates an internal double spout in the spoutless container, functioning on the same basis of cohesion and adhesion as in the spouted container in FIG. 1 and FIG. 2. The No-Splatter blade 6 is in the form of a rectangle extending across the diameter of the container 3. The bottom of the blade 6 cuts the liquid, which is then poured from either side of the container 3 where the No-Splatter blade 6 connects with the container 3 side.

Figure 7:
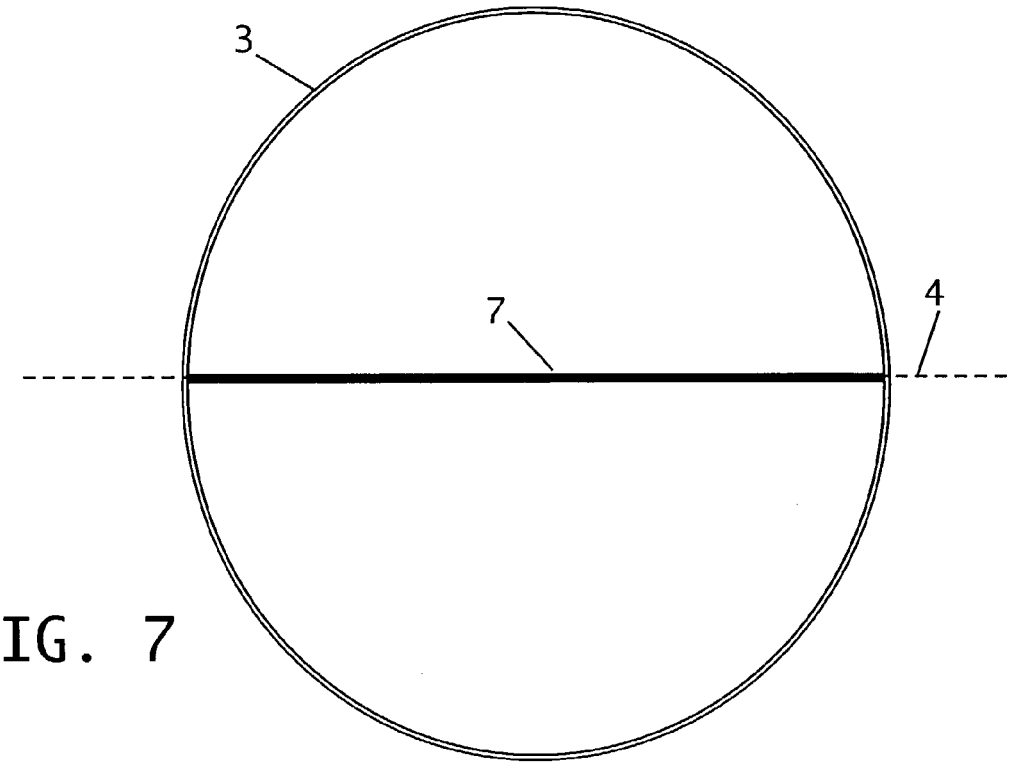
FIG. 7 is a top view of a spoutless container that shows the top of the arched No-Splatter blade extending across the diameter of the container.
Figure 8:
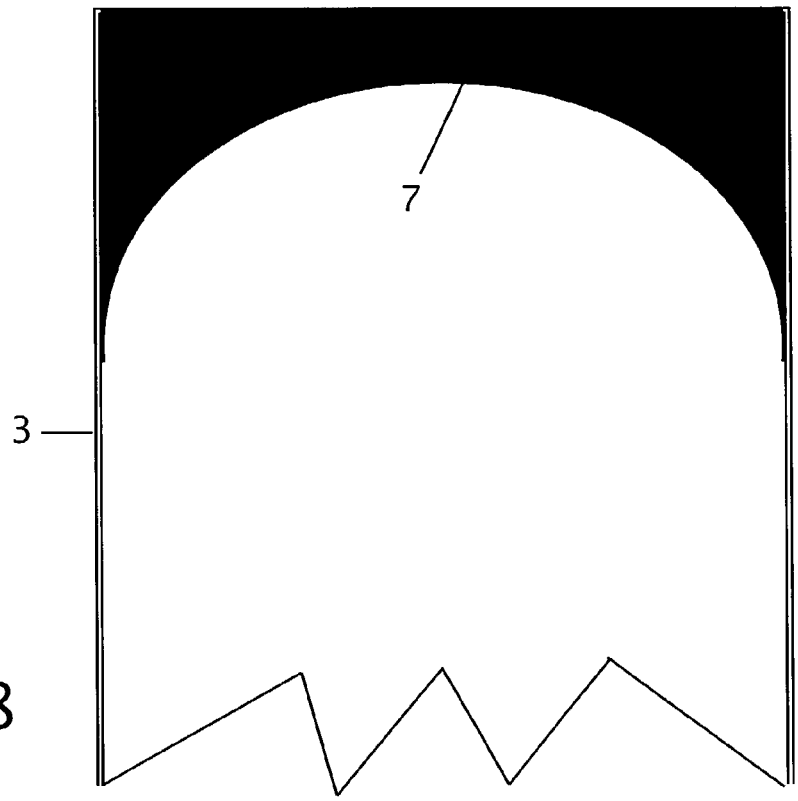
FIG. 8 is a vertical cross-sectional view of a spoutless container showing the profile of the arched No-Splatter blade extending across the diameter of the container.

FIG. 7 and FIG. 8 are identical to FIG. 6 and FIG. 8 respectively, except that the bottom of the No-Splatter blade 7 is arched. This allows for a longer liquid "cutting" surface and takes up less space.

What is claimed is:

1. The combination of a container and a no-splatter blade for dispersing a viscous thick liquid from the container, comprising:

a container having an inner surface and a bottom surface defining a volume for holding the viscous thick liquid, an opening in said inner surface, a longitudinal axis, a spout having an inner surface defining a further volume which joins said volume at said opening, and an upper edge defining a plane; and a no-splatter blade formed as a triangular plate, said triangular plane having two general parallel surface defining three edges with one of said edges positioned to lie in said plane defined by said upper edge of said container when said triangular plate is assembled in said spout and with the other two edges extending into said spout such that one edge engages said inner surface and said three edges lie in a plane which intersects said plane defined by said upper edge of said spout and which includes said longitudinal axis, wherein:

the viscous thick liquid as poured from said container through said spout is divided by said triangular plate to form two streams of the viscous thick liquid due to the adhesion of the stream with respect to their engagement with said surfaces of said triangular plate, following which engagement cohesion of the molecules pulls the liquid streams together to avoid splattering.

* * * * *